US009038869B2

(12) United States Patent
Moreau et al.

(10) Patent No.: US 9,038,869 B2
(45) Date of Patent: May 26, 2015

(54) DOUBLE TOOL POUCH WITH RETRACTOR POCKETS

(71) Applicant: Ty-Flot, Inc., Manchester, NH (US)

(72) Inventors: Darrell A. Moreau, Manchester, NH (US); Andre W. Moreau, Spring Hill, FL (US)

(73) Assignee: Ty-Flot, Inc., Manchester, NH (US)

( * ) Notice: Subject to any disclaimer, the term of this patent is extended or adjusted under 35 U.S.C. 154(b) by 130 days.

(21) Appl. No.: 13/964,341

(22) Filed: Aug. 12, 2013

(65) Prior Publication Data

US 2015/0021372 A1 Jan. 22, 2015

Related U.S. Application Data

(60) Provisional application No. 61/856,497, filed on Jul. 19, 2013.

(51) Int. Cl.

| | |
|---|---|
| ***A45F 5/02*** | (2006.01) |
| *A45F 5/00* | (2006.01) |
| *A45F 5/10* | (2006.01) |

(52) U.S. Cl.

CPC . *A45F 5/02* (2013.01); *A45F 5/004* (2013.01); *A45F 5/022* (2013.01); *A45F 2200/05* (2013.01); *A45F 2005/108* (2013.01); *A45F 5/102* (2013.01)

(58) Field of Classification Search

CPC ..... A45F 5/02; A45F 5/004; A45F 5/021; A45F 5/022; A45F 5/102; A45F 2005/108; A45F 2200/05

USPC ..... 224/162, 904

See application file for complete search history.

(56) References Cited

U.S. PATENT DOCUMENTS

| | | | | | |
|---|---|---|---|---|---|
| 5,505,356 | A * | 4/1996 | Noriega et al. | ..... | 224/250 |
| 5,511,705 | A * | 4/1996 | Dreszer | ..... | 224/666 |
| 5,833,095 | A * | 11/1998 | Russell et al. | ..... | 224/576 |
| 6,179,185 | B1 * | 1/2001 | Dancyger | ..... | 224/576 |
| 6,698,632 | B1 * | 3/2004 | Turner et al. | ..... | 224/196 |
| D676,234 | S * | 2/2013 | Moreau et al. | ..... | D3/228 |
| 2002/0014507 | A1 * | 2/2002 | Snider et al. | ..... | 224/671 |
| 2002/0145027 | A1 * | 10/2002 | Godshaw et al. | ..... | 224/605 |
| 2004/0099705 | A1 | 5/2004 | Skupin | | |
| 2005/0177928 | A1 * | 8/2005 | Moreau et al. | ..... | 2/421 |
| 2005/0242144 | A1 * | 11/2005 | Panosian et al. | ..... | 224/665 |
| 2008/0017683 | A1 * | 1/2008 | Votel | ..... | 224/677 |
| 2009/0294495 | A1 * | 12/2009 | Moreau et al. | ..... | 224/219 |
| 2010/0032465 | A1 * | 2/2010 | Moreau et al. | ..... | 224/660 |
| 2012/0247994 | A1 * | 10/2012 | Moreau et al. | ..... | 206/373 |
| 2015/0014382 | A1 * | 1/2015 | Hintze, Ian | ..... | 224/661 |

* cited by examiner

*Primary Examiner* — Brian D Nash

(74) *Attorney, Agent, or Firm* — Mesmer & Deleault PLLC

(57) ABSTRACT

A tool holder has a first tool pouch connected to the front surface of a substrate and defining a first tool compartment between the first tool pouch and the substrate. A second tool pouch is connected to the front surface of the substrate and defines a second tool compartment between the second tool pouch and the substrate, where the first tool pouch is at least partially disposed within the second tool pouch. A first retractor pocket is attached to the back surface of the substrate and defines a first retractor compartment that communicates through an opening in the substrate to the first tool compartment. A second retractor pocket attached to the first tool pouch front surface and defines a second retractor compartment between the second retractor pocket and the first tool pouch. The second retractor compartment communicates through a second retractor opening to the second tool compartment.

11 Claims, 7 Drawing Sheets

DOUBLE TOOL POUCH WITH RETRACTOR POCKETS

This application claims the benefit of U.S. provisional application Ser. No. 61/856,497, filed on Jul. 19, 2013.

BACKGROUND OF THE INVENTION

1. Field of the Invention

The present invention relates generally to tool accessories and more particularly to a tool pouch with retractor pockets.

2. Description of the Prior Art

Carpenters, electricians, facilities maintenance personnel, and other workers often use a tool belt or pouch to hold tools. One example is a tool pouch that attaches to a tool belt and is designed to hold a small number of tools, such as a pouch to hold a pair of pliers and one or two screwdrivers. Tool pouches of this type are useful for storing tools between tasks and help to prevent misplaced tools.

In addition to preventing misplaced tools, workers seek to avoid accidental drops, particularly when working on a ladder, scaffold, or other elevated location. Lanyards, tethers, hooks, and similar restraints have been used to prevent accidental drops. These restraints are particularly useful in environments where a tool drop can cause substantial damage or harm to plant equipment, workers, or objects below a worker who accidentally drops a tool. One method of restraining tools is to clip one end of a tether to the tool and to clip the other end of the tether to a tool belt or to a nearby structure. For smaller tools and smaller-capacity tool pouches, a tether sometimes gets in the way of using the tool or with placing the tool in the pouch.

One approach to solving this problem is described by Skupin in US published patent application no. 2004/0099705 for a tool bag that can be carried next to a person's body. The Skupin application discloses a tool bag having a carrier body and a plurality of tool compartments arranged next to one another on the carrier body. Each tool compartment is designed to hold one tool. A retaining line with a retractor device is provided for each tool compartment such that the retaining line can be pulled out of and automatically retrieved back into the tool bag. Retaining lines have a capsule with a spring-biased reel. The capsules are contained in a compartment accessed from the back side of the carrier body and covered with a closeable cover. Each retaining line extends through a hole in the carrier body for attachment to a tool.

SUMMARY OF THE INVENTION

The Skupin tool bag has individual tool compartments arranged adjacent one another laterally across the tool holder. However, the approach taken by Skupin is not optimal for a tool pouch having a plurality of tool pockets, where one or more pocket is nested or located at least partially within another pocket. A retractor compartment located on the back side of the tool bag is poorly positioned for a tool stored in nested tool pockets. More specifically, for a tool stored in a forward-positioned tool pocket, its tether extends over other tools in the pouch in order to reach the retractor positioned in a compartment on the back side of the bag.

A tool bag with two or more nested pouches and having tethers that all originate from retractors located in the rear part of the tool holder would result in a web of tethers that prevent access to some tools and that easily become tangled unless the user is diligent about observing removal and replacement of a tool from the pouch so as to prevent crossing or tangling multiple lines. In most cases, the worker cannot or does not want to scrutinize the act of placing a tool in the tool pouch every time he stores the tool. Workers work more efficiently and safely when tools can be removed and replaced without tangled tethers and tethers that limit access to other tools.

Thus, a need exists for an improved tool holder that has a plurality of tool pouches in addition to having pouches or pockets for a plurality of tether retractors.

It is an object of the present invention to permit workers to quickly switch between tethered tools without interference from tethers connected to other tools.

It is another object of the present invention to permit each tool pouch to have its own compartment for storing a retractor.

The present invention achieves these and other objectives by providing a tool holder having a plurality of tool pouches with a retractor compartment for each tool pouch. In one embodiment, the tool holder has a substrate with a body portion, an upper end portion, a lower end portion, a first side portion, a second side portion, a front surface, a back surface, and a first retractor opening through the substrate. A first tool pouch is connected to substrate to define a first tool compartment on the front side of the substrate. The first tool pouch has a first pouch first side portion, a first pouch second side portion, a first pouch lower end portion, a first pouch upper end portion, a first pouch inside surface, and a first pouch outside surface. The first tool pouch first side portion and the first tool pouch second side portion attach to corresponding first side portion and second side portion of the substrate or spaced a predefined distance from one or both of the corresponding first side portion and second side portion of the substrate to define the first tool compartment between the first tool pouch inside surface and the front surface of the substrate.

A second tool pouch has a second tool pouch front surface, a second tool pouch back surface, a second tool pouch first side portion attached to the substrate, a second tool pouch second side portion attached to the substrate, a second tool pouch lower end portion attached to the substrate, and a second tool pouch upper end portion. The second tool pouch defines a second tool compartment on the front side of the substrate between the second tool pouch back surface and the front surface of the substrate, where the first tool pouch is at least partially disposed within the second tool compartment.

A first retractor pocket is attached to the back surface of the substrate and defines a first retractor compartment in fluid communication with the first retractor opening. A second retractor pocket is attached to the first tool pouch front surface. A second retractor pocket upper end portion defines a second retractor opening. The second retractor pocket defines a second retractor compartment between the second retractor pocket back surface and the first tool pouch front surface where the second retractor compartment is in fluid communication with the second retractor opening.

In another embodiment, the first tool pouch first side portion is attached to the first side portion and the first tool pouch second side portion is attached to the second side portion.

In another embodiment, the first tool pouch lower end portion is attached to the substrate between the first side portion and the second side portion. In one embodiment, the first tool pouch lower end portion attaches to the substrate along the lower end portion.

In another embodiment, the first tool pouch first side portion and the second tool pouch first side portion are attached along the first side portion of the substrate. The first tool pouch second side portion and the second tool pouch second side portion are attached along the second side portion of the substrate.

In another embodiment, the tool holder includes an additional tool pouch at least partially disposed within the second tool compartment and positioned adjacent the first tool pouch.

In another embodiment, the tool holder has at least one retractor disposed within one or more of the retractor compartments.

In another embodiment, the tool holder has an additional tool pouch with an additional tool pouch inside surface, where the additional tool pouch is attached to the substrate and defines an additional tool compartment between the additional tool pouch inside surface and the second tool pouch front surface and where the second tool pouch is at least partially disposed within the additional tool pouch. An additional retractor pocket is attached to the second tool pouch front surface and has an additional retractor pocket top end portion that defines an additional retractor opening.

In another embodiment, the first retractor opening width is less than the width of the first retractor compartment width. Preferably the first retractor opening width is between about one-quarter to about one-half of the width of the first retractor compartment. In another embodiment, the second retractor opening width is between about one-quarter to about one-half of the width of the second retractor compartment.

In another embodiment, the second retractor pocket defines a closeable second retractor pocket mouth between a second retractor pocket lower end portion and the first tool pouch front surface.

DETAILED DESCRIPTION OF THE PREFERRED EMBODIMENT

Figure 1:
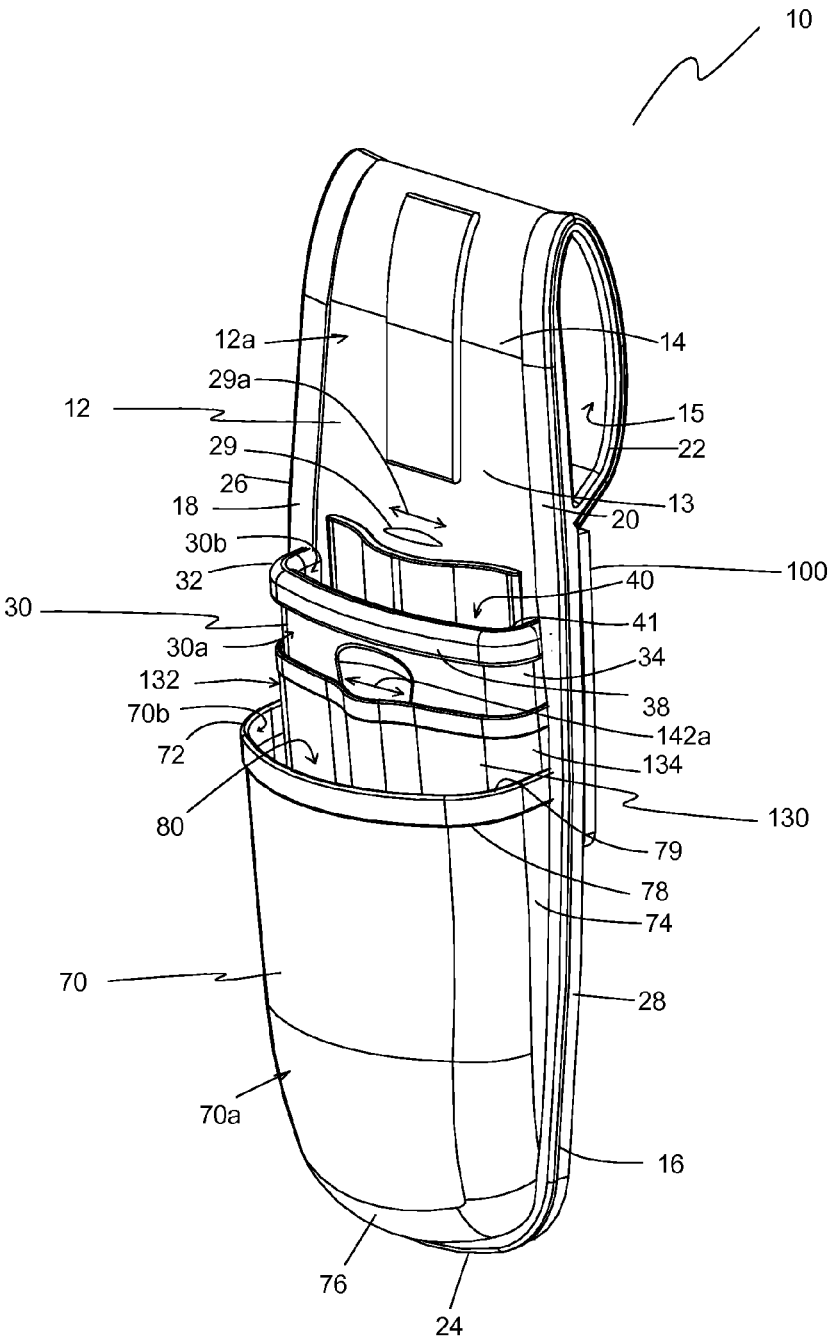
FIG. 1 is a front perspective view of one embodiment of a tool holder of the present invention.

The preferred embodiments of the present invention are illustrated in FIGS. 1-6. FIG. 1 illustrates one embodiment of a tool holder 10 that includes a substrate 12, a first tool pouch 30, a first retractor pocket 100, a second tool pouch 70, and a second retractor pocket 130. In one embodiment, substrate 12 has a vertically-elongated body portion 13, an upper end 14 portion, a lower end portion 16, a first side portion 18, a second side portion 20, a front surface 12*a*, and a back surface 12*b* (shown in FIG. 2). It is intended that front surface 12*a* faces away from the user's body and back surface 12*b* faces towards and/or rests against the user's body when tool holder 10 is worn on a tool belt. Substrate 12 defines a first retractor opening 29 with a first retractor opening width 29*a*. First retractor opening 29 is preferably a slit or narrow opening; other shapes, such as round, rectangular, or oval are also acceptable. First retractor opening 29 extends through substrate 12 and communicates with a first retractor compartment 110 (not visible) of first retractor pocket 100, which is discussed below with reference to FIG. 2. Substrate 12 is preferably made of pliant material, such as a textile made with synthetic or natural fibers, leather, Cordura®, plastic, or the like. When substrate 12 is a textile, it optionally has a backing 15 on back surface 12*b* that is waterproof and/or wear-resistant.

In one embodiment, upper end portion 14 of substrate 12 defines a belt loop 22 for use with a tool belt or strap. Belt loop 22 may be formed by folding or bending substrate 12 back on itself and connecting it to body portion 13 with stitching, rivets, hook-and-loop fasteners, or other means. In other embodiments, upper end portion 14 defines a plurality of spaced-apart vertical slots (not shown) through substrate 12 for receiving a tool belt transversely through the slots. A tool belt (not shown) or strap may pass through the vertical slots to hold tool holder 10. In yet other embodiments, upper end portion 14 has a clip or other connector (not shown) attached to upper end portion 14 for attaching tool holder 10 to a tool belt or other object.

First tool pouch 30 has an front surface 30*a*, a back surface 30*b*, a first pouch first side portion 32, a first pouch second side portion 34, a first pouch lower end portion 36 (not visible; shown in FIG. 5), a first pouch upper end portion 38, and a first mouth portion 41. In one embodiment, first pouch first side portion 32 is attached to substrate 12 along first side portion 18 and first pouch second side portion 34 is attached to substrate 12 along second side portion 20. First pouch lower end portion 36 is attached to substrate 12 between first side portion 18 and second side portion 20, preferably along lower end portion 16. Thus, a first tool compartment 40 is defined between front surface 12*a* of substrate 12 and back surface 30*b* of first tool pouch 30 with back surface 30*b* being generally spaced apart from front surface 12*a* of substrate 12. First tool compartment 40 has a predefined first tool compartment width 42 at first mouth portion 41 and a predefined first tool compartment depth 44 (shown in FIG. 3) measured from first mouth portion 41 to the bottom of first tool compartment 40.

First mouth portion 41 preferably remains open to provide easy access to first tool compartment 40. Optionally, first mouth portion 41 is closeable or partially closeable by fastening to substrate 12 with a snap, button, hook-and-loop fastener, or the like. In other embodiments, first tool pouch upper end portion 38 zips closed by securing a zipper (not shown) between substrate 12 and first tool pouch upper end portion 38 or by tightening a drawstring (not shown) around first mouth portion 41. In still other embodiments, first mouth portion 41 is stretchable or includes a stretchable member (not shown) that causes first mouth portion 41 to close when not stretched to open it.

A second tool pouch 70 has a second tool pouch front surface 70*a*, a second tool pouch back surface 70*b*, a second tool pouch first side portion 72, a second tool pouch second side portion 74, a second tool pouch lower end portion 76, a second tool pouch upper end portion 78, and a second mouth portion 79. In one embodiment, second tool pouch first side portion 72 is attached to substrate 12 along first side portion 18, second tool pouch second side portion 74 is attached to substrate 12 along second side portion 12, and second tool pouch lower end portion 76 is attached to substrate 12 between first side portion 18 and second side portion 20, preferably along lower end portion 16. Thus, a second tool compartment 80 is defined between front surface 12*a* of substrate 12 and back surface 70*b* of second pouch 70, where back surface 70*b* is generally spaced apart from front surface 12*a*. Second tool compartment 80 has a second tool compartment width 82 at second mouth portion 79 and a second tool compartment depth 84 (width and depth are both shown in FIG. 5) measured from second mouth portion 79 to the bottom of second tool compartment 80. First pouch 30 is at least partially disposed or nested within second tool compartment 80 of second tool pouch 70. Accordingly, at least first pouch lower end portion 36 is positioned between second pouch back surface 70*b* and front surface 12*a* of substrate 12. With first tool pouch 30 being at least partially disposed within second tool compartment 80, second tool compartment width 82 is at least as great as first tool compartment width 42.

Figure 2:
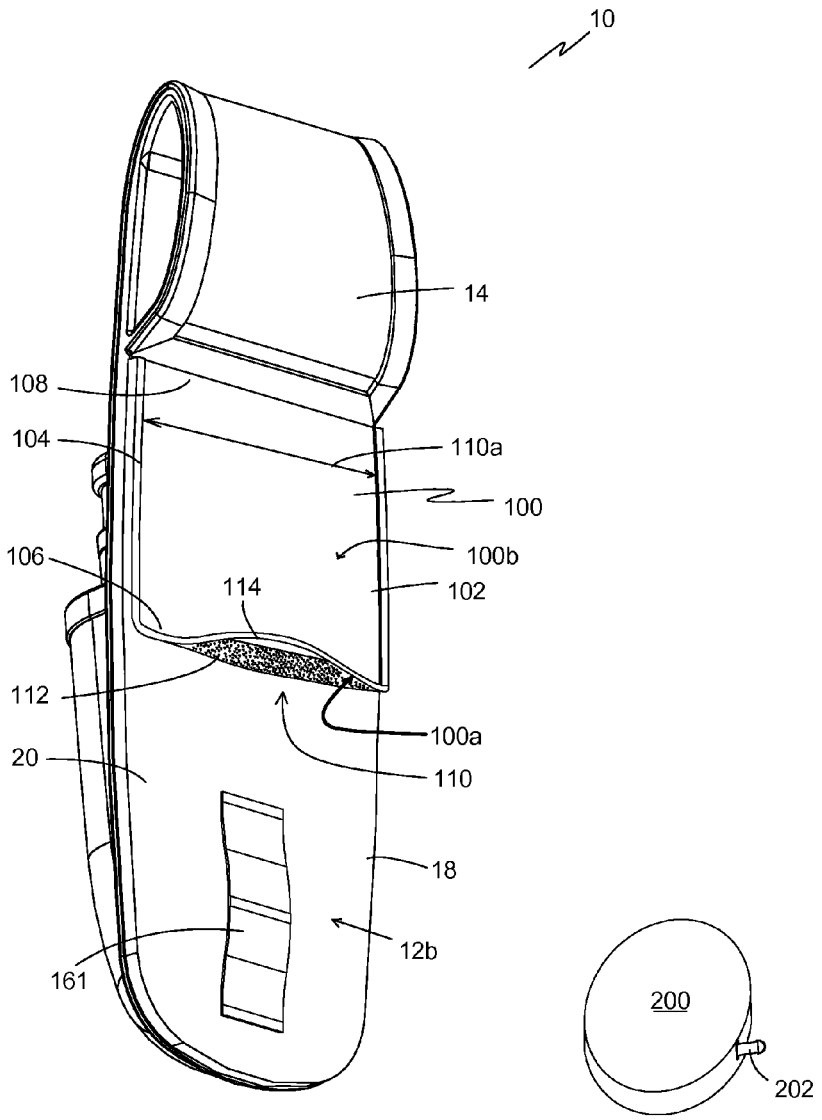
FIG. 2 is a back perspective view of the tool holder of FIG. 1 showing the first retractor pocket.

Referring now to FIG. 2, tool pouch 10 is shown in a rear perspective view with first retractor pocket 100 in a partially-open position. Tool pouch 10 has first retractor pocket 100 with a first retractor pocket front surface 100*a* (not visible), a first retractor pocket back surface 100*b*, a first retractor pocket first side portion 102, a first retractor pocket second side portion 104, a first retractor pocket lower end portion 106, and a first retractor pocket upper end portion 108. In one embodiment, first retractor pocket 100 is attached to back surface 12*b* of substrate 12 along two or more first retractor side portions 102, 104, 106, 108. First retractor pocket 100 is attached to substrate 12, for example, by stitching, rivets, snaps, buttons, adhesive, hook-and-loop fastener, or other means or a combination of means. Thus, first retractor pocket 100 defines a first retractor compartment 110 between front surface 100*a* of first retractor pocket 100 and back surface 12*b* of substrate 12. First retractor opening width 29*a* (shown in FIG. 1) is less than a width 110*a* of first retractor compartment 110. In one embodiment, first retractor opening width 29*a* is between about one-quarter to one-half of width 110*a* of first retractor compartment.

First retractor compartment 110 communicates with a tool (not shown) disposed in first tool pocket 30 via first retractor opening 29 through substrate 12. Preferably, first retractor pocket 100 is sized to house and retain a retractor 200 with a retractor line 202 where retractor line 202 or a tether connected to retractor 200 extends through first retractor opening 29. In place of retractor 200, it is acceptable to place an object that is larger than first retractor opening width 29*a* in first retractor compartment 110 to anchor the non-tool end of a tether to tool holder 10. For example, a tether extends through first retractor opening 29 and connects to a washer, block, or other item held within first retractor compartment 110.

In one embodiment, at least one first retractor side portion 102, 104, 106, 108 is releasably attached to back surface 12*b* of substrate 12 using, for example, a hook-and-loop fastener, button(s), snap(s), zipper(s), or other means to define an opening 114 that is selectively closeable. Using opening 114, one or more retractor 200 may be placed in and removed from first retractor pocket 100 as needed.

In one embodiment, first retractor pocket first side portion 102 is fixedly attached along first side portion 18 of substrate 12, first retractor pocket second side portion 104 is fixedly attached along second side portion 20, and first retractor pocket upper end portion 108 is fixedly attached to back surface 12*b* at or near upper end portion 14 between first side portion 18 and second side portion 20. First retractor pocket lower end portion 106 is preferably releasably attached to back surface 12*b* with a hook-and-loop fastener 112 or other means. Thus, first retractor compartment 110 is accessible from back surface 12*b* through opening 114 and from front surface 12*a* through first retractor opening 29 (shown in FIG. 1). In other embodiments, first retractor pocket 100 is attached along opposite portions (e.g., first retractor pocket upper end portion 108 and first retractor pocket lower end portion 106) where retractor 200 or other object may be placed in first retractor compartment 110 through opening 114 defined by one or both opposing and unsecured portions (e.g., first retractor pocket first side portion 102 and/or first retractor pocket second side portion 104).

Figure 3:
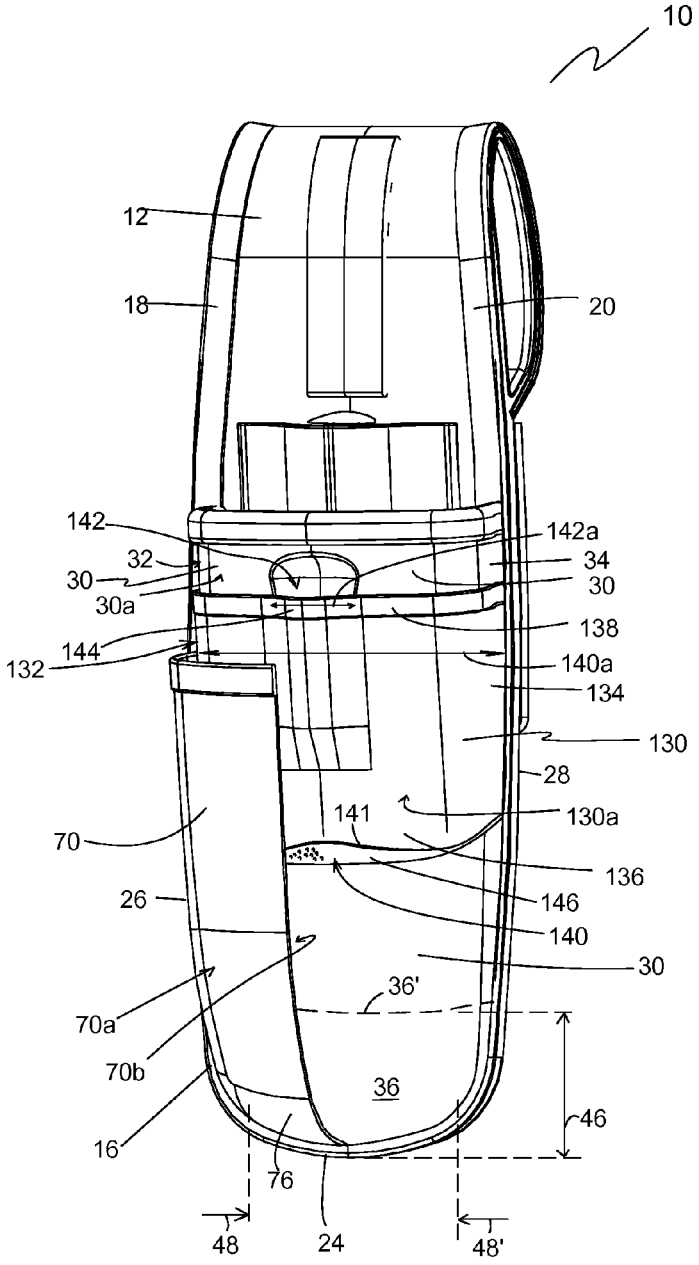
FIG. 3 is a front perspective view of the tool holder of FIG. 1 showing a portion of the second tool pouch cut away to reveal the second retractor pouch lower end portion.

Referring now to FIG. 3, a front perspective view of tool holder 10 is illustrated and shows second tool pouch 70 partially cut away for clarity. In the embodiment shown in FIG. 3, first tool pouch lower end portion 36 connects along lower end portion 16 of substrate 12. In other embodiments, first tool pouch lower end portion 36 connects to substrate 12 between first side portion 18 and second side portion 20 a predefined distance 46 up from lower end 24 of substrate 12 at a position indicated by broken line 36'. This option provides a reduced first tool compartment depth 44 for smaller tools. In yet other embodiments, first tool pouch lower end portion 36 is not connected to substrate 12, where first tool compartment has an open lower end that communicates with second tool compartment 80. In such an embodiment, first tool pouch 30 functions similar to a divider to separate first tool compartment 40 from second tool compartment 80 (shown in FIG. 4) to accommodate different tool types or for ease of assembling tool holder 10.

In some embodiments, first tool pouch first side portion 32 attaches to substrate 12 a predefined side distance 48 from a first edge 26 of substrate 12 and/or first tool pouch second side portion 34 attaches to substrate 12 a second predefined side distance 48' from a second edge 28 of substrate 12. With these options, first tool pouch width 42 (shown in FIG. 5) may range in size between being substantially the same as and being noticeably smaller than second tool pouch width 82. Similarly, first tool pouch lower end portion 36 may be attached at substantially the same position on substrate 12 as second tool pouch lower end portion 76, or may be attached in a position above that of second tool pouch lower end portion 76.

A second retractor pocket 130 is attached to first tool pouch front surface 30*a* and has a second retractor pocket front surface 130*a* and a second retractor pocket back surface 130*b* (not visible). Second retractor pocket 130 has a second retractor pocket first side portion 132, a second retractor pocket second side portion 134, a second retractor pocket upper end portion 138, and a second retractor pocket lower end portion 138. In one embodiment, second retractor pocket first side portion 132 is attached along first side portion 18 of substrate 12, second retractor pocket second side portion 134 attaches along second side portion 20 of substrate 12, second retractor pocket lower end portion 136 releasably attaches to first tool pouch front surface 30*a*. Thus, second retractor pocket 130 defines a second retractor pocket mouth 149 between first tool pouch first side and second retractor pocket side portions 132, 134. Second retractor pocket lower end portion 136 preferably attaches to first tool pouch front surface 30*a* using a hook-and-loop fastener 146.

Figure 5:
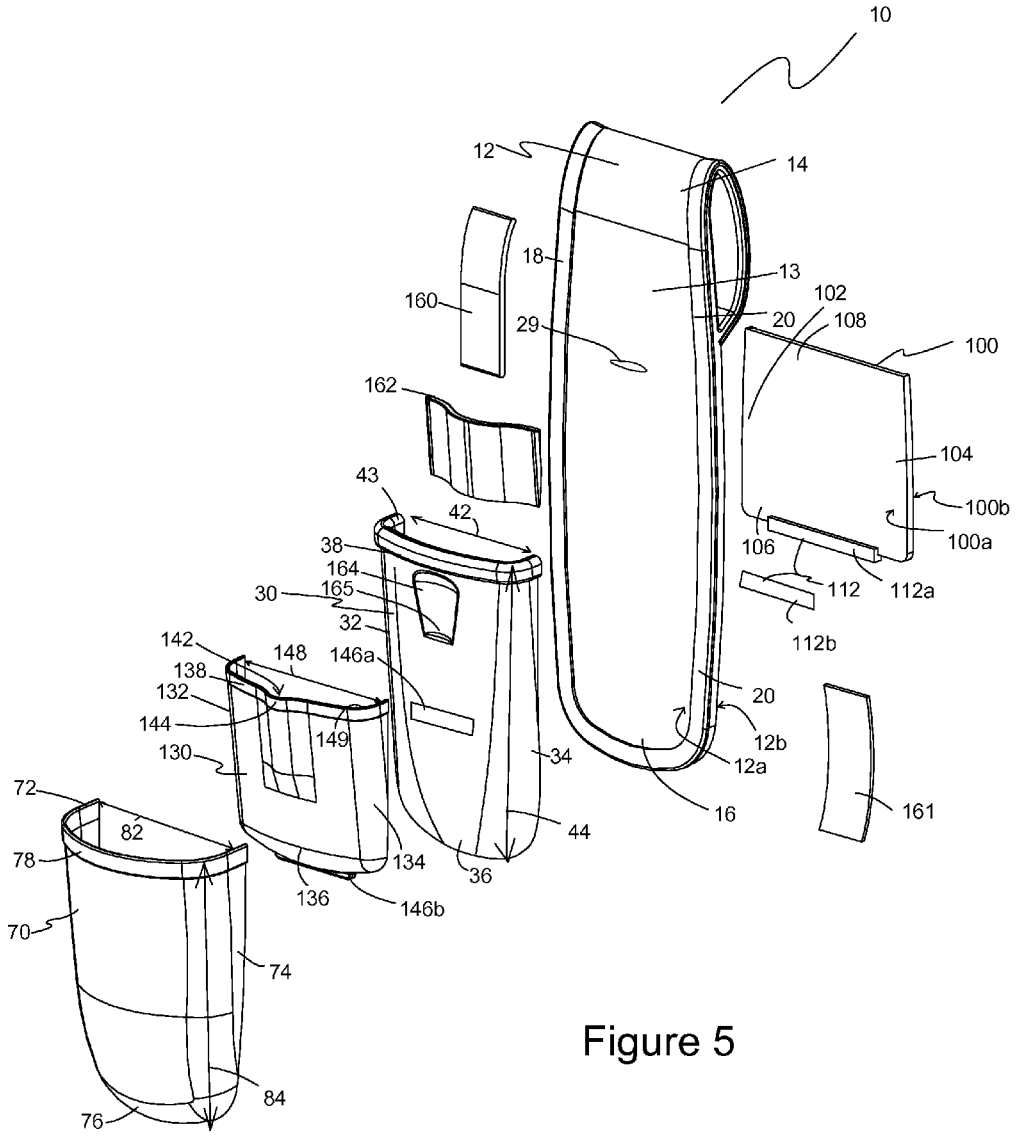
FIG. 5 is a front perspective view of the tool holder of FIG. 1 shown exploded.

Second retractor pocket first side portion 132 and/or second retractor pocket second side portion optionally attach to first tool pouch front surface 30*a*, resulting in a narrower second retractor compartment width 148 at second retractor pocket mouth 149 (both shown in FIG. 5).

Second retractor pocket upper end portion 138 attaches to one or more portions of first tool pouch front surface 30*a* between second retractor pocket first side portion 132 and second retractor pocket second side portion 34, forming a second retractor pocket opening 142 between first tool pouch front surface 30*a* and an unattached portion 144 of second retractor pocket upper end portion 138. In another embodiment, second retractor opening 142 is a slit or opening through second retractor pocket 130. Thus, second retractor pocket 130 defines a second retractor compartment 140 between second retractor pocket back surface 130*b* and first tool pouch front surface 30*a* that communicates through second retractor opening 142 with a tool disposed in second tool pouch 70. Second retractor compartment 140 is preferably sized to hold at least one retractor 200 (shown in FIG. 2) or other tool retention device that is too large to pass through second retractor opening 142. A width 142*a* (also shown in FIG. 1) of second retractor opening 142 is less than a width 140*a* of second retractor compartment 140. In one embodiment, width 142*a* is about one-quarter to about one-half of width 140*a*.

Being positioned on first tool pouch front surface 30*a*, second retractor pocket 130 is positioned between second tool pouch front surface 70*a* and substrate 12. Second retractor pocket 130 is also positioned between second tool pouch back surface 70*a* and first tool pouch front surface 30*a*.

Figure 4:
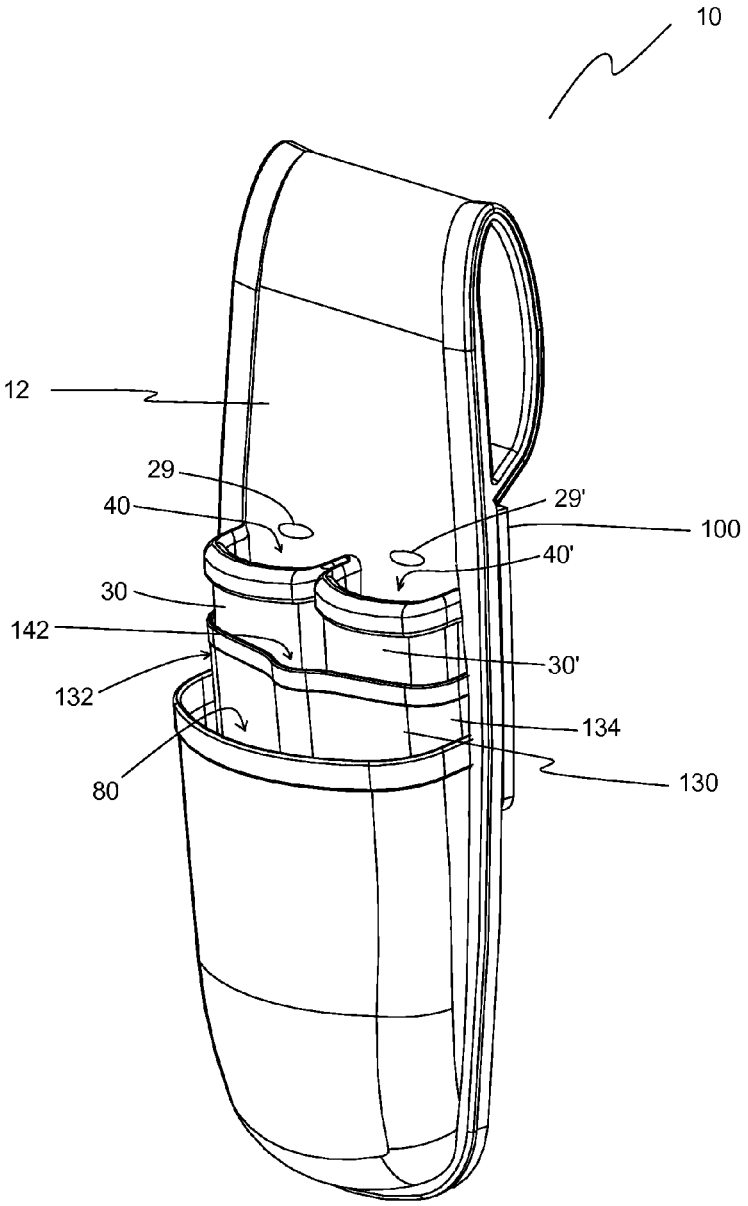
FIG. 4 is a front perspective view of another embodiment of a tool holder of the present invention showing a first tool pouch adjacent an additional first tool pouch.

Referring now to FIG. 4, one embodiment of tool holder 10 has an additional first tool pouch 30' that is preferably similar or identical to first tool pouch 30. Additional first tool pouch 30' is attached to substrate 12 adjacent first tool pouch 30, where additional first tool pouch 30' and first tool pouch 30 are at least partially disposed within second tool compartment 80. Lanyard attachments to retractors 200 contained in first retractor pocket 100 may extend through a single first retractor opening 29. Optionally, additional first tool pouch 30' has a corresponding additional first retractor opening 29'. As with tool holder 10 shown in FIG. 1, the embodiment shown in FIG. 4 has second retractor pocket 130 with second retractor opening 142. In one embodiment, second retractor pocket first side portion 132 attaches to first tool pouch 30 and second retractor pocket second side portion 134 attaches to additional first tool pouch 30'. In another variation of embodiment of FIG. 4, second retractor pocket 130 attaches to substrate 12 as discussed above.

Referring now to FIG. 5, tool holder 10 of FIG. 1 is shown exploded in a perspective view to illustrate its construction. In one method of making tool holder 10, substrate 12, first retractor pocket 100, first tool pouch 30, second retractor pocket 130, and second tool pouch 70 are provided. First retractor opening 29 is cut or formed in body portion 13 of substrate 12 towards upper end portion 14. Substrate 12 is optionally folded back over itself to define a belt loop 22 and stitched to back surface 12*b* of substrate at a position above first retractor opening. Other connection means may be used. When substrate 12 is used to define belt loop 12 as described here, substrate 12 optionally extends continuously to also define first retractor pocket 100. In such an embodiment, the attachment of substrate 12 to itself to define belt loop 22 may also be the attachment of first retractor pocket upper end portion 108 to back surface 12*b* of substrate 12. In other embodiments, first retractor pocket 100 is a separate textile panel that is stitched to back surface 12*b* of substrate 12, where first retractor pocket upper end portion 108 is attached to substrate 12 above first retractor opening 29. First retractor pocket first side portion 102 and first retractor pocket second side portion 104 are preferably stitched or otherwise attached to substrate 12 to define first retractor compartment 110 (shown in FIG. 2). First retractor compartment lower edge portion 106 is closeable to substrate 12 by a first part 112*a* of a hook-and-loop fastener 112 stitched or adhered to front surface 100*a* of first retractor pocket lower edge portion 108 and a second part 112*b* of hook-and-loop fastener 112 stitched or adhered to back surface 12*b* of substrate 12.

First part 146*a* of hook-and-loop fastener 146 is attached to first tool pouch front surface 30*a* and a second part 146*b* of hook-and-loop fastener 146 is attached to back surface 130*b* of second retractor pocket lower end portion 138. Second retractor pocket upper end portion 138 is attached to first tool pouch front surface 30*a*, leaving an unattached portion 144 to define second retractor opening 142. Second retractor pocket upper end portion 138 is preferably aligned slightly below first tool pouch upper end portion 32 so as not to interfere with hand tools placed in first tool pouch 30.

First tool pouch 30, second retractor pocket 130, and second tool pouch 70 are positioned to overlap one another in a nesting fashion with second retractor pocket 130 positioned between first tool pouch 30 and second tool pouch 70. First tool pouch first side portion 32, second retractor pocket first side portion 132, and second tool pouch first side portion 72 are preferably each aligned with first side portion 18 of substrate 12. First tool pouch second side portion 34, second retractor pocket second side portion 134, and second tool pouch second side portion 74 are preferably each aligned with second side portion 20 of substrate 12. First tool pouch lower end portion 36 and second tool pouch lower end portion 76 are preferably each aligned with lower end portion 16 of substrate 12. First side portions 32, 132, 72, 18; second side portions 34, 134, 74, 20; and lower end portions 76, 36, 16 are preferably stitched or otherwise fastened together.

Optionally, a strap or loop 160 is attached to front surface 12*a* of substrate 12 above first retractor opening 29 and a second strap or loop 161 (also shown in FIG. 2) is attached to back surface 12*b* of substrate adjacent the lower end portion 16. To attach tool holder 10 to a harness or other object, upper end portion 14 of substrate may be folded back so that loop 160 and second loop 161 are both positioned on the back of tool holder 10. A releasable strap is passed through loop 160 and/or second loop 161 and around the vertical harness straps of a harness to secure tool holder 10 to the harness. Wear-resistant members 162, 164 are optionally attached to substrate 12 below first retractor opening 29 and to the front surface 30*a* of first tool pouch 30 in the vicinity of second retractor opening 142. To provide longer wear of tool holder 10, optional wear-resistant members 162, 164 reinforce areas exposed to sliding movement of retractor line 202 or tether (not shown) and to areas prone to wear from inserting tools into and removing tools from tool holder 10. Wear-resistant members 162, 164 may be made of fabric, plastic, metal or other material. Wear-resistant members 162, 164 may be substantially planar as shown, for example, with wear-resistant member 162, or may be shaped as shown, for example, with wear-resistant member 164 to define a receptacle 165 that receives a tool connector 180 (shown in FIG. 6) or cable guide (not shown).

Figure 6:
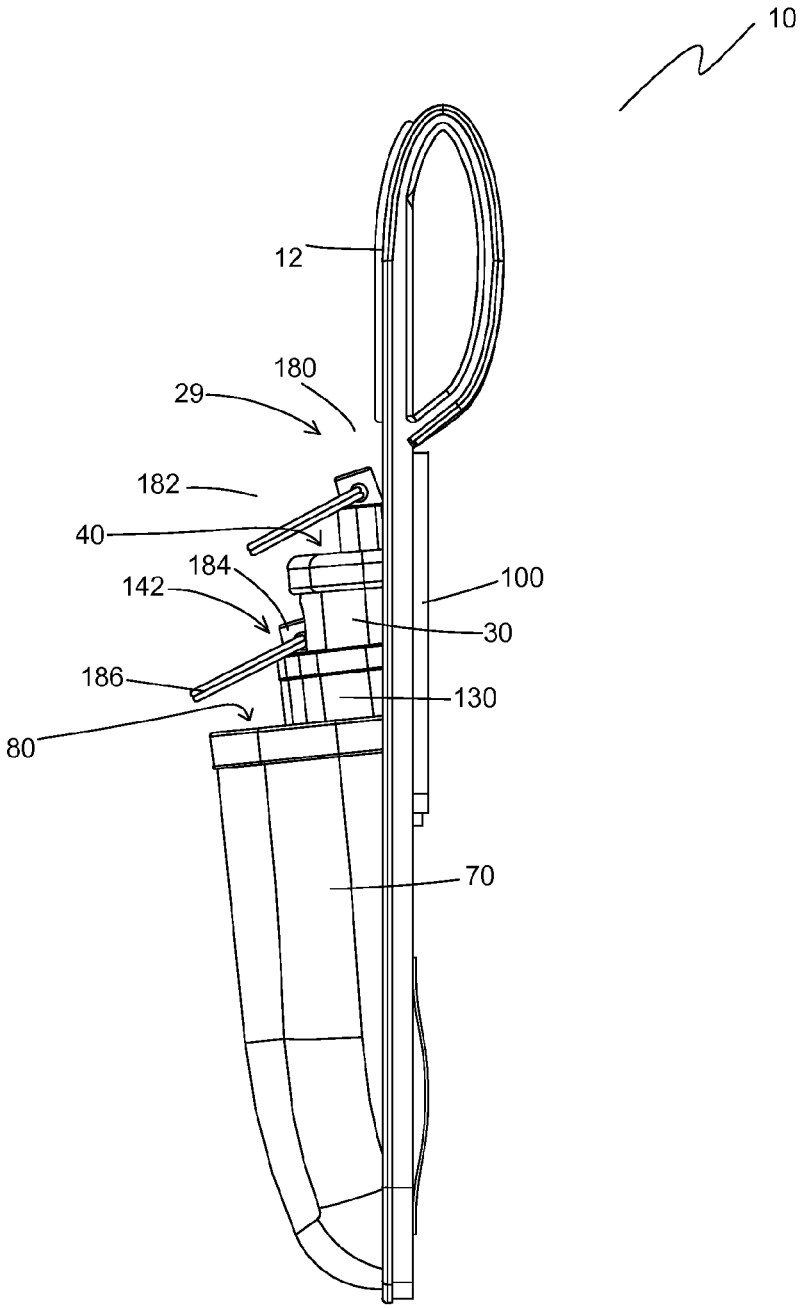
FIG. 6 is a side view of the tool holder of FIG. 1 showing a tool holder of the present invention equipped with tool connectors and connector rings.

Referring now to FIG. 6, a side view shows tool holder 10 of FIG. 1 assembled with substrate 12, first tool pouch 30 defining first tool compartment 40, and second tool pouch 70 defining second tool compartment 80. A first tool connector 180 with first connector ring 182 extends from first retractor opening 29 and connects to retractor 200 (not visible) disposed in first retractor pocket 100. A second tool connector 184 with second connector ring 186 extends from second retractor opening 142 and connects to another retractor 200 (not visible) disposed in second retractor pocket 130. Second tool connector 184 is received and seated in receptacle 165 defined by wear-resistant member 164 (shown in FIG. 5).

Figure 7:
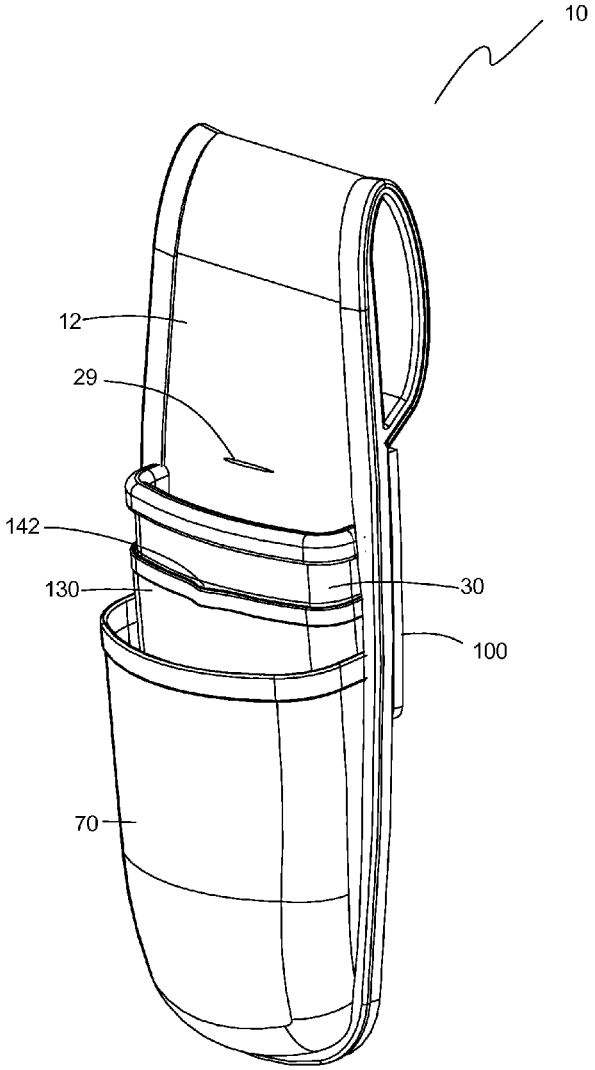
FIG. 7 is a front perspective view of another embodiment of the tool holder of the present invention shown without some optional features.

Referring now to FIG. 7, another embodiment of tool holder 10 is shown with substrate 12, first tool pouch 30, second tool pouch 70, first retractor pocket 100, and second retractor pocket 130. First retractor opening 29 is in fluid communication with first retractor compartment 110 (not visible) and second retractor opening 142 is in fluid communication with second retractor compartment 140 (not visible) behind second retractor pocket 130. Wear-resistant members 162, 164 (not shown) are omitted in this embodiment.

As shown in the Figures discussed above, tool holder 10 has first tool pouch 30 and second tool pouch 70. In other embodiments, tool holder 10 optionally has one or more additional tool pouch 70' constructed similarly to second tool pouch 70. In such an embodiment, second tool pouch 70 is at least partially nested within additional tool pouch 70', which is at least partially nested within second additional tool pouch 70", etc. In such an embodiment, each additional tool pouch 70', 70", etc. has an additional retractor pocket 100', 100", respectively, on the corresponding second tool pouch front face 70*a* or additional tool pocket front face 70'*a*, etc.

In use, a tool (not shown) is disposed in first tool pouch 30 and connected to first connector ring 182. Similarly, a second tool (not shown) is disposed in second tool pouch 70 and connected to second connector ring 184. Because each tool is tethered to its own retractor 200 disposed in a retractor compartment 110, 140 associated with each tool pouch 30, 70, respectively, accidental tool drops are prevented with reduced entanglement of tethers. Because tethers do not extend across one tool compartment (e.g., first tool compartment 40) to connect to a tool stored in a second tool compartment (e.g., second tool compartment 80), tangling and interference with tool operation is reduced or minimized. Therefore, worker efficiency and safety is improved.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A tool holder comprising:

a substrate having a body portion, an upper end portion, a lower end portion, a first side portion, a second side portion, a front surface, and a back surface, the substrate defining a first retractor opening therethrough with a first retractor opening width;

a first tool pouch having a first pouch first side portion, a first pouch second side portion, a first pouch lower end portion, a first pouch upper end portion, a first pouch front surface, and a first pouch back surface, the first pouch first side portion and the first pouch second side portion attached to the substrate, wherein the first tool pouch defines a first tool compartment between the first pouch back surface and the front surface of the substrate;

a second tool pouch having a second tool pouch front surface, a second tool pouch back surface, a second tool pouch first side portion attached to the substrate, a second tool pouch second side portion attached to corresponding first side portion and second side portion of the substrate or spaced a predefined distance from at least one of the corresponding first side portion and second side portion of the substrate, a second tool pouch lower end portion attached to the substrate, and a second tool pouch upper end portion, the second tool pouch defining a second tool compartment between the second tool pouch back surface and the front surface of the substrate, wherein the first tool pouch is at least partially disposed within the second tool compartment;

a first retractor pocket attached to the back surface of the substrate and defining a first retractor compartment in fluid communication with the first retractor opening, wherein the first retractor opening width is smaller than a width of the first retractor compartment; and a second retractor pocket attached to the first tool pouch front surface and having a second retractor pocket upper end portion defining a second retractor opening with a second retractor opening width, the second retractor pocket defining a second retractor compartment between the second retractor pocket back surface and the first tool pouch front surface in fluid communication with the second retractor opening, wherein the second retractor opening width is less than a width of the second retractor compartment.

2. The tool holder of claim 1, wherein the first tool pouch first side portion is attached to the first side portion and the first tool pouch second side portion is attached to the second side portion.

3. The tool holder of claim 1, wherein the first tool pouch lower end portion is attached to the substrate between the first side portion and the second side portion.

4. The tool holder of claim 3, wherein the first tool pouch lower end portion attaches to the substrate along the lower end portion.

5. The tool holder of claim 1, wherein the first tool pouch first side portion and the second tool pouch first side portion are attached along the first side portion and wherein the first tool pouch second side portion and the second tool pouch second side portion are attached along the second side portion.

6. The tool holder of claim 1, further comprising an additional tool pouch at least partially disposed within the second tool compartment and positioned adjacent the first tool pouch.

7. The tool holder of claim 1, further comprising at least one retractor disposed within one or more of the first retractor compartment and the second retractor compartment.

8. The tool holder of claim 1, further comprising:

an additional tool pouch with an additional tool pouch inside surface, the additional tool pouch attached to the substrate and defining an additional tool compartment between the additional tool pouch inside surface and the second tool pouch front surface, wherein the second tool pouch is at least partially nested within the additional tool pouch; and an additional retractor pocket attached to the second tool pouch front surface and having an additional retractor pocket top end portion defining an additional retractor opening.

9. The tool holder of claim 1, wherein the first retractor opening width is between about one-quarter to about one-half of the width of the first retractor compartment.

10. The tool holder of claim 1, wherein the second retractor opening width is between about one-quarter to about one-half of the width of the second retractor compartment.

11. The tool holder of claim 1, wherein the second retractor pocket defines a closeable second retractor pocket mouth between a second retractor pocket lower end portion and the first pouch front surface.

* * * * *